United States Patent [19]

Jones

[11] 4,137,024

[45] Jan. 30, 1979

[54] ROTOR FOR ROTARY PISTON MECHANISM

[75] Inventor: Charles Jones, Hillsdale, N.J.

[73] Assignee: Curtiss-Wright Corporation, Wood-Ridge, N.J.

[21] Appl. No.: 816,436

[22] Filed: Jul. 18, 1977

[51] Int. Cl.[2] ..... F01C 1/02; F01C 5/02; F01C 5/06; F01C 19/06

[52] U.S. Cl. ..... 418/61 A; 418/116; 418/122; 418/124; 418/156

[58] Field of Search ..... 418/61 A, 112, 113, 418/116, 122, 123, 143, 153, 156

[56] References Cited

U.S. PATENT DOCUMENTS

| | | | |
|---|---|---|---|
| 659,530 | 10/1900 | Jackson | 418/143 |
| 1,098,256 | 5/1914 | Harper | 418/122 |
| 2,050,473 | 8/1936 | Steinmann | 418/153 |
| 3,463,090 | 8/1969 | Gordinier | 418/153 |
| 3,954,355 | 5/1976 | Paul, Jr. | 418/112 |
| 4,043,714 | 8/1977 | Berkowitz | 418/123 |

FOREIGN PATENT DOCUMENTS

| | | | |
|---|---|---|---|
| 1846 of | 1881 | United Kingdom | 418/122 |

*Primary Examiner*—John J. Vrablik
*Attorney, Agent, or Firm*—Arthur Frederick; Victor D. Behn

[57] ABSTRACT

The improved rotor is for a rotary compressor or expansion engine of the type having a rotor supported for planetation in a multi-lobe housing cavity and comprises an endless band embracing the peripheral surface of the rotor, which band functions to continuously engage at the apex portions of the rotor, the peripheral surface of the housing cavity and thereby seal the working chambers from each other as the rotor rotates within the cavity.

5 Claims, 8 Drawing Figures

ROTOR FOR ROTARY PISTON MECHANISM

This invention relates to rotary piston mechanisms such as compressors and expansion engines, and more specifically, to an improved rotor for a rotary piston mechanism of the type wherein the rotor is supported for planetary rotation in a multi-lobe housing cavity.

BACKGROUND OF THE INVENTION

In rotary piston mechanisms of various types having multi-lobe housing cavities, such as those disclosed in the U.S. patents to Wankel et al, U.S. Pat. No. 2,988,065 dated June 13, 1961; Nubling U.S. Pat. No. 2,866,417 dated Dec. 30, 1958; Kraic et al, U.S. Pat. No. 3,323,498 dated June 6, 1967; Kolbe et al, U.S. Pat. No. 3,671,154 dated June 20, 1972; Batten, U.S. Pat. No. 2,873,250 dated Mar. 25, 1975; Huf, U.S. Pat. No. 3,797,974 dated Mar. 19, 1974 and Huf, U.S. Pat. No. 3,923,430 dated Dec. 2, 1975, the working chambers formed between the rotor and the housing cavity walls are isolated from each other and surrounding areas by a sealing grid assembly comprising side wall sealing means and apex seals carried by the rotor or non-rotating seal elements disposed at the junctions of the housing cavity lobes. Heretofore, it was not considered possible to provide optimum volumetric efficiency by employing both apex seals and non-rotating seal elements (hereinafter referred to as "waist seals") because of the rapid failure of the seals due to the accumulative effects of repeated impacts between the apex seals and the non-rotating seal elements. While counterweighted apex seals which function to retract at the lobe junctures are known and disclosed in various U.S. patents, such as the patent to Jones, U.S. Pat. No. 3,456,626 dated July 22, 1969; Jones U.S. Pat. No. 3,482,551 dated Dec. 9, 1969 and Kumar, U.S. Pat. No. 3,909,013 dated Sept. 30, 1975, the use of such apex seals in combination with waist seals would not eliminate the impact problem without an appreciable increase in leakage or blow-by at the apex seals. The prior art teaching, as exemplified in the U.S. patent to Batten, U.S. Pat. No. 3,873,250 and the French patent to Planche, U.S. Pat. No. 590,085 dated June 10, 1925, which disclose the pressurization of the apex seals to bias them outwardly of the grooves, even at the lobe junctures, obviously do not provide a solution to the impact problem. One solution to the problem is disclosed in the co-pending U.S. patent application, Ser. No. 689,184, filed May 24, 1976, now U.S. Pat. No. 4,043,714, which discloses fluid pressure actuated "nose" or apex seals. These seals are relatively complex and unsuited for inexpensive compressors or other types of rotary mechanisms.

Another object of the present invention is to provide an improved rotor for a rotary piston mechanism of the multi-lobe type which simplifies the sealing grip system and thereby renders the entire mechanism relatively inexpensive.

A further object is to provide for a rotary piston mechanism of the multi-lobe type, an improved rotor which maintains continuous sealing contact with the waist seals and, at its apex portions, with the inner peripheral surface of the housing cavity as the rotor planetates.

A feature of this invention is to provide the improved rotor for a rotary piston mechanism of the multi-lobe type, having waist seals, with an endless, flexible band embracing the periphery of the rotor which band is capable of automatic flexure for the maintenance of engagement, at various points, with the peripheral wall of the cavity as the rotor planetates with the housing cavity while avoiding impacts with the waist seals.

SUMMARY OF THE INVENTION

Accordingly, the present invention contemplates an improved rotor for a rotary piston mechanism of the type comprising a housing having axially-spaced end walls and a peripheral wall interconnecting the end walls to form a multi-lobe cavity therebetween. The rotor is mounted within the cavity for rotation on an axis eccentric to the housing cavity axis with its opposite side faces disposed adjacent the housing end walls. The rotor has a profile or periphery consisting of a plurality of converging flank surfaces interconnected by blunt, rounded apex portions. The rotor defines with the housing walls a plurality of working chambers which vary in volumetric size as the rotor rotates relative to the housing. Intake and exhaust ports are provided for passing fluid into and from the working chambers as the latter change in volumetric size.

The improvement in the rotor comprises an endless flexible belt or band which overlies the flank and apex surfaces of the rotor and extends substantially the full distance between the opposite end faces. The band functions to continuously seal, adjacent the apex surfaces of the rotor, the peripheral wall of the housing and thereby maintain the working chambers separate from each other as the rotor rotates within the housing cavity.

In a second embodiment of the invention a tensioning means is carried by the rotor at each of the flank surfaces to resiliently bias the band in a direction radially outward of the rotor axis of rotation.

In a third embodiment, the tensioning means is carried by the rotor not only at each of the flank surfaces but also at each of the apex surfaces of the rotor.

In a fourth embodiment, the tensioning means is carried by the rotor only at each of the apex surfaces of the rotor.

It is a feature of this invention to provide a tensioning means which includes a pressure plate slidably receivable in a recess in the rotor and biased by a spring to force the band radially outward beyond the line of the rotor profile when not restrained inwardly by engagement with the peripheral wall and/or stationary waist seals of the housing cavity.

BRIEF DESCRIPTION OF THE DRAWING

The invention will be more fully understood from the following detailed description thereof when considered in connection with the accompanying drawing wherein several embodiments of the invention are illustrated by way of example and in which.

Description of the Preferred Embodiments

Figure 2:
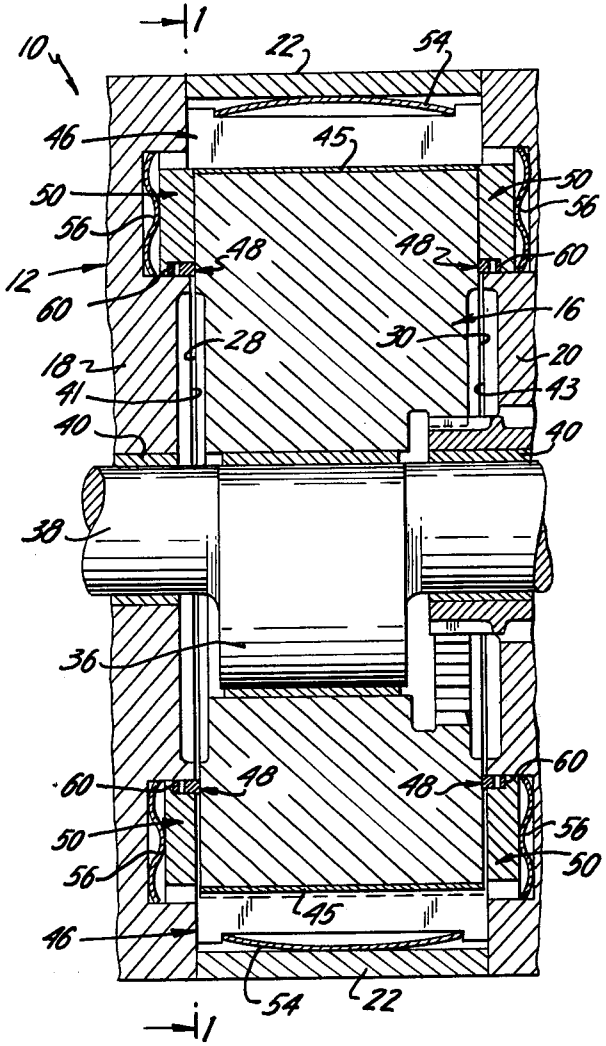
FIG. 2 is a view in cross-section taken along line 2—2 of FIG. 1.
Figure 1:
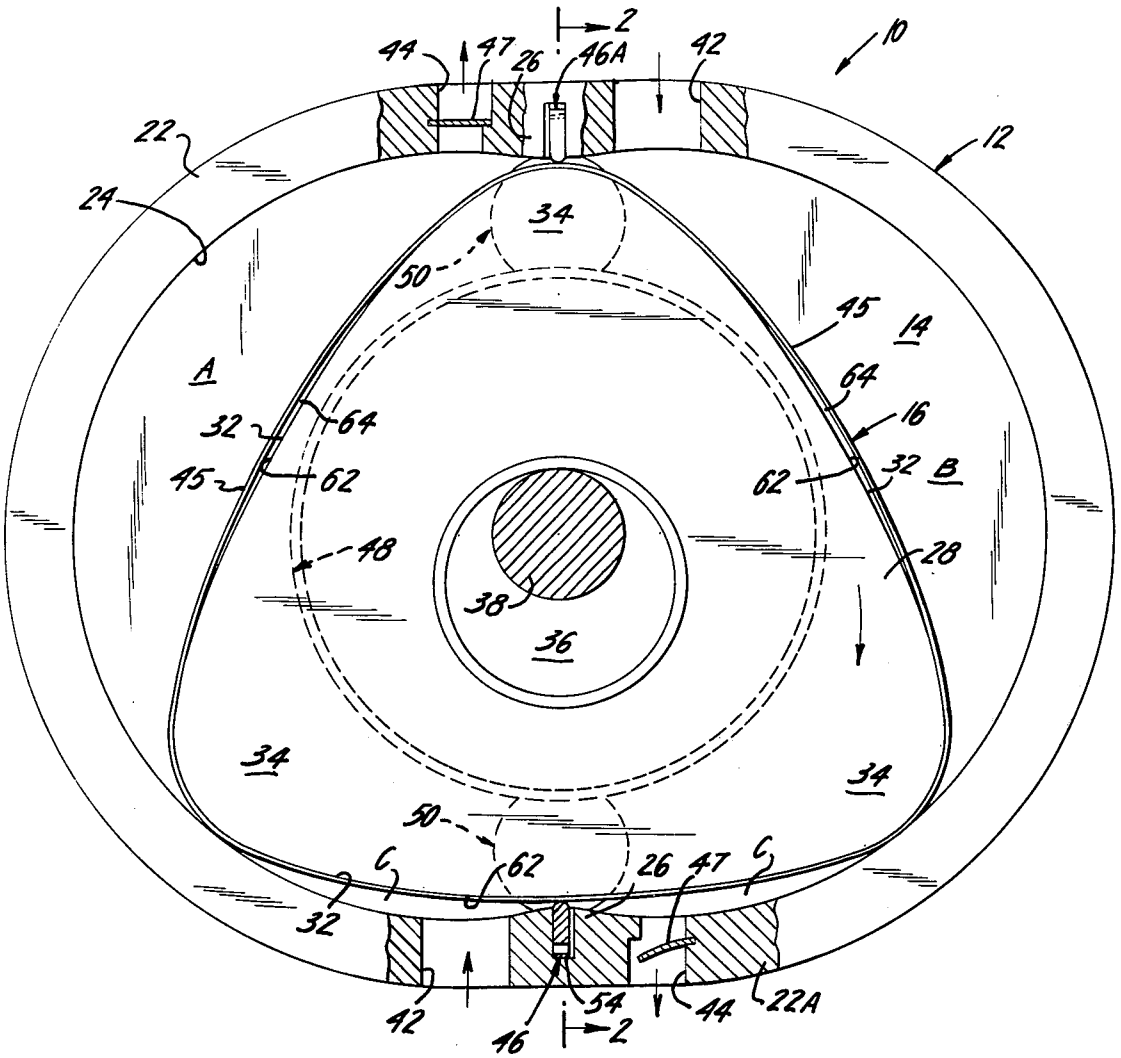
FIG. 1 is a cross-sectional view taken along line 1—1 of FIG. 2 showing a rotary piston compressor with a rotor, according to a first embodiment of the invention.

Now referring to the drawings and, more particularly, to FIGS. 1 and 2, the reference number 10 generally designates a rotary piston mechanism of the trochoidal type which has a rotor 16, according to a first embodiment of this invention.

While rotary piston mechanism 10 is shown and will be described as a compressor, it is to be understood that the improved rotor 16 has application to expansion engines and pumps without departure from the scope and spirit of this invention. Furthermore, while rotary piston mechanism 10 is shown as comprising a housing 12, having a cavity 14 of two lobes with rotor 16 of generally triangular profile, it is to be understood that the invention also has application to rotary piston mechanisms having other than two lobes and a rotor having other than three apex portions.

In the rotary piston mechanism 10 as shown in FIGS. 1 and 2, housing 12 has end walls 18 and 20 abutting opposite ends of a peripheral wall 22, the walls being suitably secured together by means, such as by bolts and dowels (not shown), to form the multi-lobe housing cavity 14. The peripheral wall 22 has a surface 24 conforming in shape to the trace of a hypotrochoidal generated outer envelope of the plural lobe type. As illustrated, the cavity is of the two-lobe type with junctures of the lobes located at 26.

The rotor 16 of the rotary piston mechanism 10 comprises a body portion having opposite, substantially parallel side faces 28 and 30 and three peripheral surfaces or flanks 32. The three flanks 32 converge at opposite ends to give the rotor a generally triangular profile. The area of convergence of the flanks 32 form apex or nose portions 34. The peripheral configuration of rotor 16 is in a line substantially parallel to the trace of the inner envelope of a hypotrochoid. In the case of a rotary piston mechanism of the hypotrochoidal type, as shown in the Maillard British Patent No. 583,035 dated Dec. 5, 1946, the apex or nose portions 34 have a relatively blunt or round configuration. The rotor 16 is supported for planetary rotative movement in cavity 14 by an eccentric portion 36 of a shaft 38 which, in turn, is supported in suitable bearings 40 disposed in end walls 18 and 20. The rotor 16 is of a width which is substantially equal to the width of peripheral wall 22 so that side faces 28 and 30 are in close running fit with the adjacent inner surface 41 and 43 of end walls 18 and 20, respectively. The rotor 16 defines with housing 12 a plurality of working chambers A, B and C, each of which successively expand and contract in volumetric size as rotor 16 rotates in cavity 14 relative to housing 12. An endless, flexible band 45, preferably of thin, hardened steel, is disposed to overlie the flanks 32, including the surfaces at the apex portions 34. Also, the flexible band 45 may be made from high strength plastic material, e.g., polytetrafluoroethylene which has both elasticity and self-lubricating characteristics. A flexible band 45 of plastic would, as compared with one of steel, be substantially thicker in cross-section than the steel band. The purpose and function of band 45 will be more fully described hereinafter.

As illustrated, rotary mechanism 10 is a compressor having two inlet or intake ports 42 in peripheral wall 22 and two exhaust or discharge ports 44 in end wall 20. Each of the exhaust ports 44 are preferably provided with check valves 47, schematically shown in FIG. 1. Each of the intake ports 42 are connected by suitable conduits (not shown) to a source of gaseous fluid to be compressed while each of the discharge ports 44 are suitably connected to a place of use or storage of the compressed gaseous fluid (not shown). Each of the working chambers A, B and C are isolated from each other and surrounding areas by a sealing grid.

The sealing grid assembly comprises non-rotative waist seals 46 in the peripheral wall 22 at each lobe juncture 26, annular side seals 48 located in each of end walls 18 and 20, bridge seal discs 50 also disposed in end walls 18 and 20, and endless, flexible band 45 which overlies the periphery of rotor 16 and forms a part thereof.

Each of the waist seals 46 may be of a single blade construction (as shown) or of multi-blade construction, disposed in a guide groove extending radially relative to shaft 38 from surface 24 of peripheral wall 22. A biasing means 54, which may be, as shown, in the form of a spring, is provided for each waist seal to resiliently urge the blade associated with the waist seal outwardly of its groove and toward rotor flanks 32. Alternatively, or to supplement biasing means 54, waist seals 46 may also be biased by pressure fluid passed from the compression chambers.

Each of the bridge seal discs 50 is disposed in a cylindrical recess in the inner surfaces 41 and 43 of end walls 18 and 20 and is biased outwardly thereof toward side faces 28 or 30 of rotor 16 by a biasing means 56, such as a spring. Alternatively, or to supplement biasing means 56, bridge seal discs may be biased by pressure of the fluid being compressed.

The annular side seals 48 are each disposed in an annular recess in the respective inner surfaces 41 and 43 of end walls 18 and 20. A biasing means, such as a spring 60, in provided for each side seal 48 to urge it outwardly into engagement with the adjacent side face 28 or 30 of rotor 16. Alternatively, or to supplement spring 60, side seals 48 may also be biased by pressurized fluid conducted from the compression chambers. Each of the annular side seals 48 and seal discs 50 may, as shown, be sized and arranged so that the side seals are within the trace of flanks 32 of rotor 16 and engage each other to thereby completely seal the interstices between rotor side faces 28 and 30 and inner surfaces 41 and 43 of housing end walls 18 and 20. To seal the space between the periphery of each of the apex portions 34 and trochoidal surface 24 of peripheral wall 22, band 45 of rotor 16, according to a first embodiment of this invention, coacts with peripheral wall 22 to achieve such sealing.

As only shown in FIG. 1, rotor 16 has a peripheral contour or profile which is that of a line substantially parallel to the trace of the inner envelope of a hypotrochoid except at portions 62 of the flanks 32 where the actual flank surfaces are located radially inward of the line running substantially parallel to the trace. This departure from the usual parallel trace line provides a space 64 between the inner surface of the band and the surface portions 62 of the flanks. This space 64 permits band 45 to flex inwardly under differential fluid pressure across the band and the urging of waste seals 46 and/or junctures 26. In a rotor position where the fluid in a working chamber A, B or C is under compression, the flexure of the band 45 inwardly in the spaces 64 will cause extension of the band at the apices or noses 34 to thereby maintain the band in contact or, at least, close-running, sealing fit with peripheral surface 24 of housing wall 22. The band 45 is dimensioned to snuggly embrace the periphery of rotor 16, but not so tightly that it cannot rotate relative to the body of the rotor. In other words, the body portion of the rotor 16 desirably will rotate or slip slightly relative to the band, with the band creeping at a very slow rate relative to the body of the rotor. This slippage action between the rotor body and band 45 will have the effect of providing the band with a relatively long wear life. The frictional resistance at the pressurized flank surface portions 62, however, will keep the band 45 from continuously slipping relative to rotor 16. The band 45 is also dimensioned, as shown in FIG. 2, to extend substantially the full distance between housing end walls 18 and 20, so that the end edges of the band are in close running fit with the inner surfaces of end walls 18 and 20. As the rotor planetates within housing cavity 14, the band 45, adjacent apex portions 34 of the body of rotor 16, continuously effects a seal, either by direct engagement with peripheral wall 22 or by being in close running fit with the peripheral wall 22.

Figure 4:
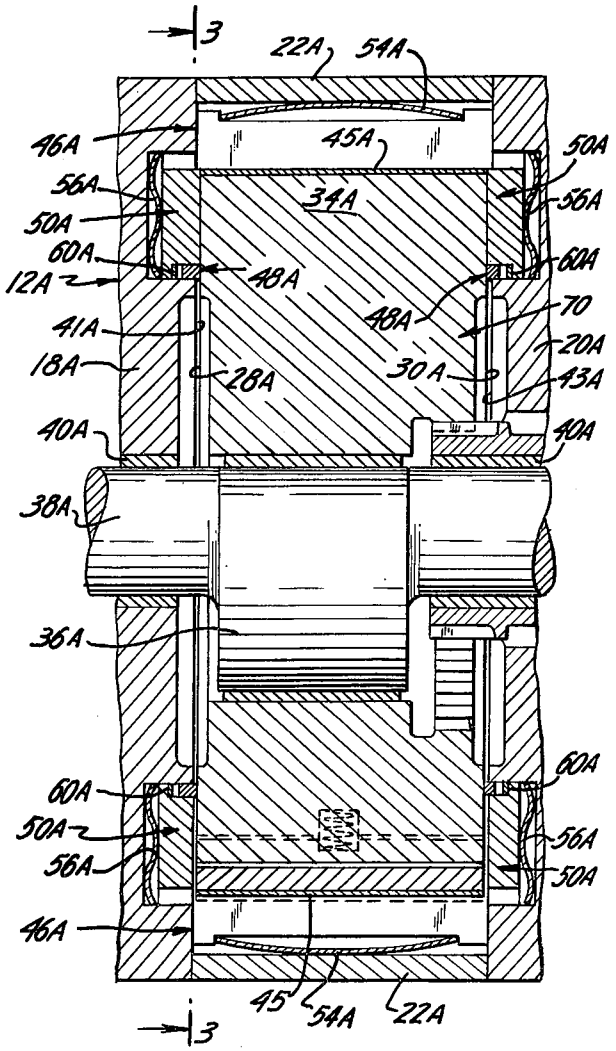
FIG. 4 is a cross-sectional view, similar to FIG. 2, taken along line 4—4 of FIG. 3.
Figure 3:
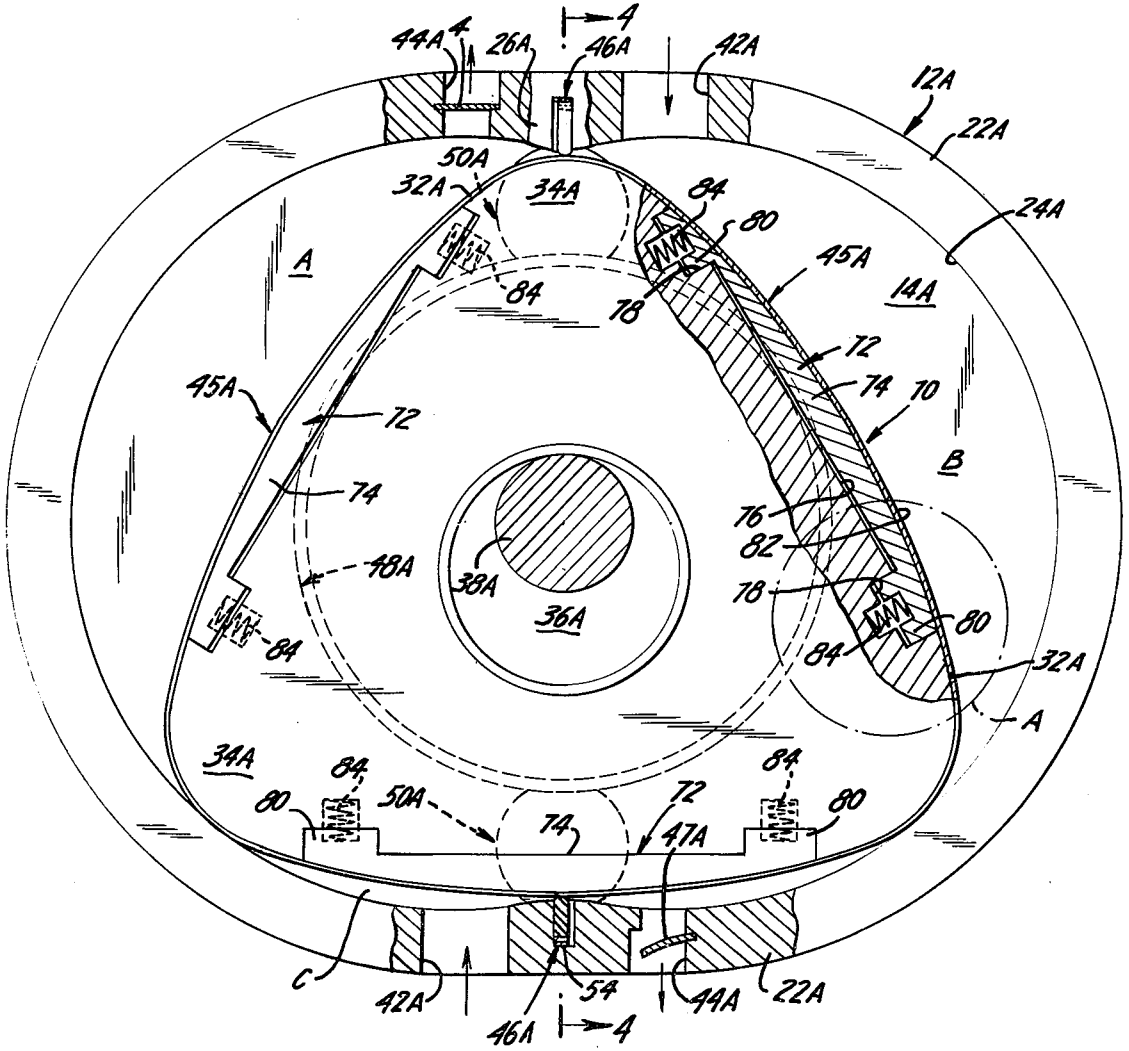
FIG. 3 is a view similar to FIG. 1 of a rotary piston compressor with a rotor, according to a second embodiment of this invention.
Figure 5:
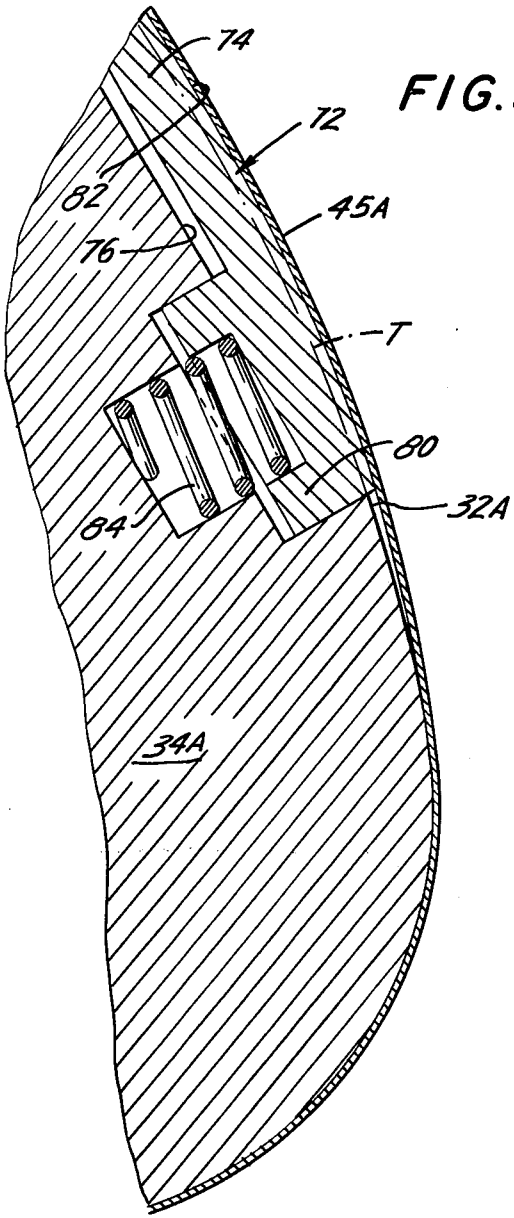
FIG. 5 is an enlarged view in section of the area designated A in FIG. 3.

In FIGS. 3, 4 and 5 is shown a rotary piston mechanism 69 having a rotor 70, according to a second embodiment of this invention. The rotor 70 differs essentially from rotor 10 shown in FIGS. 1 and 2 in that the rotor 70 includes a tensioning means which coacts with the band to maintain the latter taut yet permits the band to smoothly pass the stationary waist seals. In view of the similarity between rotary piston mechanisms 10 and 69, the parts of mechanism 69 corresponding to like parts of mechanism 10 will be identified by the same number but with the suffix A added thereto.

The rotor 70, as previously stated, has a tensioning means. The tensioning means, as shown in FIG. 3, comprises three pressure plate assemblies 72. Each pressure plate assembly 72 consists of a plate 74 extending substantially the full length of each flank 32A of the body portion of the rotor. It is dimensioned in width to extend the full width of the rotor, that is, between side faces 28A and 30A of the body of the rotor. For each plate 74 the associated flank 32A is recessed to provide a shallow recessed portion 76 communicating at opposite ends with deeper recess portions 78 which extend parallel to the axis of shaft 38A and each other. The pressure plate 74 has a central body portion of complementary size to recessed portion 76 and endmost ribs 80 sized to be slidably receivable in recesses 78. The opposite outer surface 82 of plate 74 has an arcuate surface of a shape corresponding to a portion of the line which is parallel to the trace of the inner envelope of a hypotrochoid when the plate 74 is recessed to its maximum in recess portions 76 and 78. This is best shown in FIG. 5 where the parallel line to the trace is shown in a broken line T. Also, as best illustrated in FIG. 5, plate 74 is biased radially outward of the axis of rotor 70 by a pair of springs 84. Each spring 84 is held in a recess 86 in rib portion 80 of the plate and an aligned counter-recess 88 in the bottom of recess 78. The springs 84 function to resiliently urge plate 74 against the underside of band 45A and the band radially outward of the parallel line of the trace of the rotor periphery when not restrained by engagement with the waist seals 46 and/or junctures 26 of peripheral wall 22.

Figure 8:
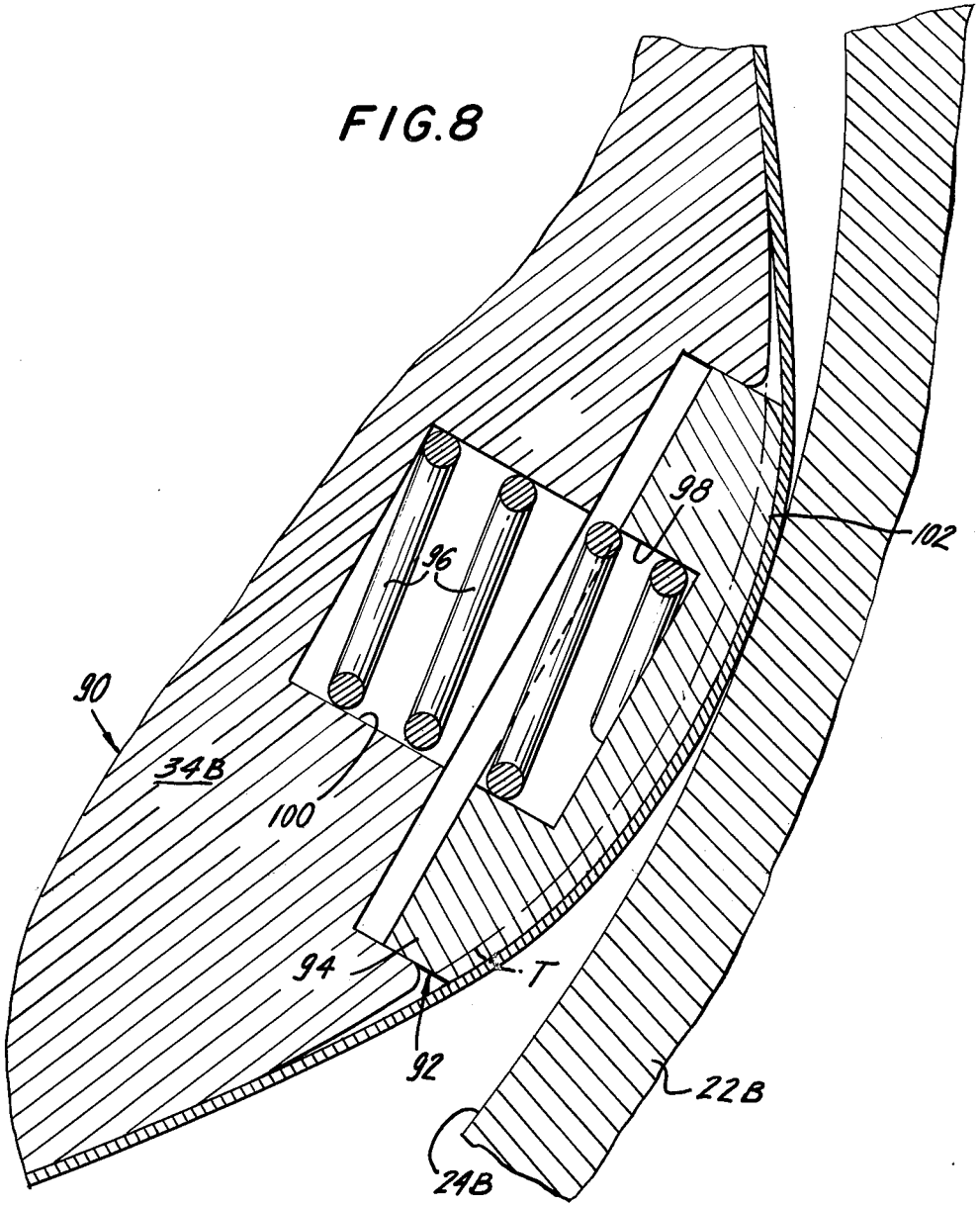
FIG. 8 is an enlarged view in section of the area B identified in FIG. 6.
Figure 7:
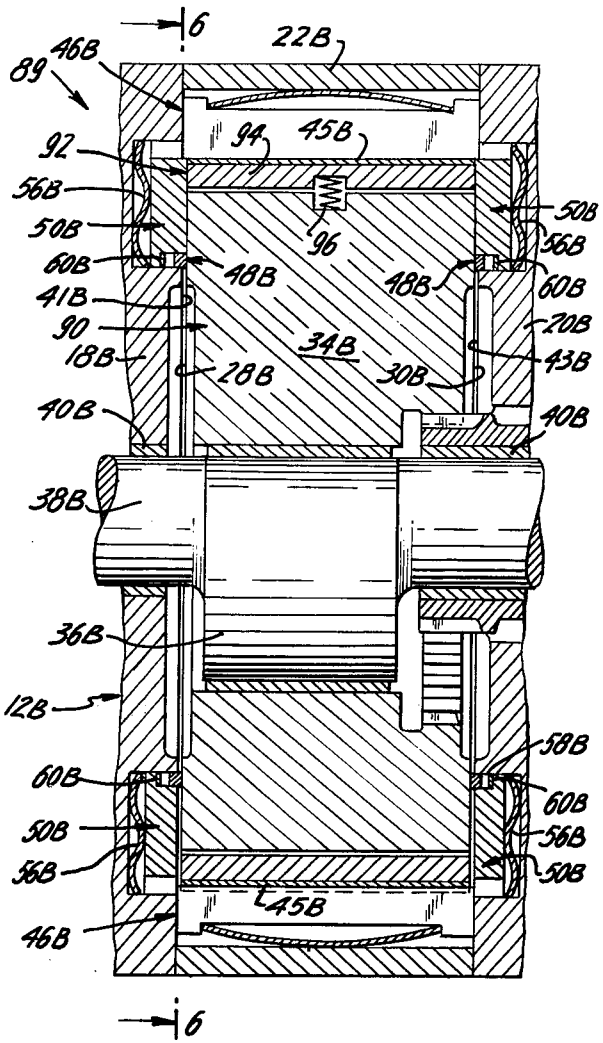
FIG. 7 is a view in cross-section taken along line 6—6 of FIG. 7.
Figure 6:
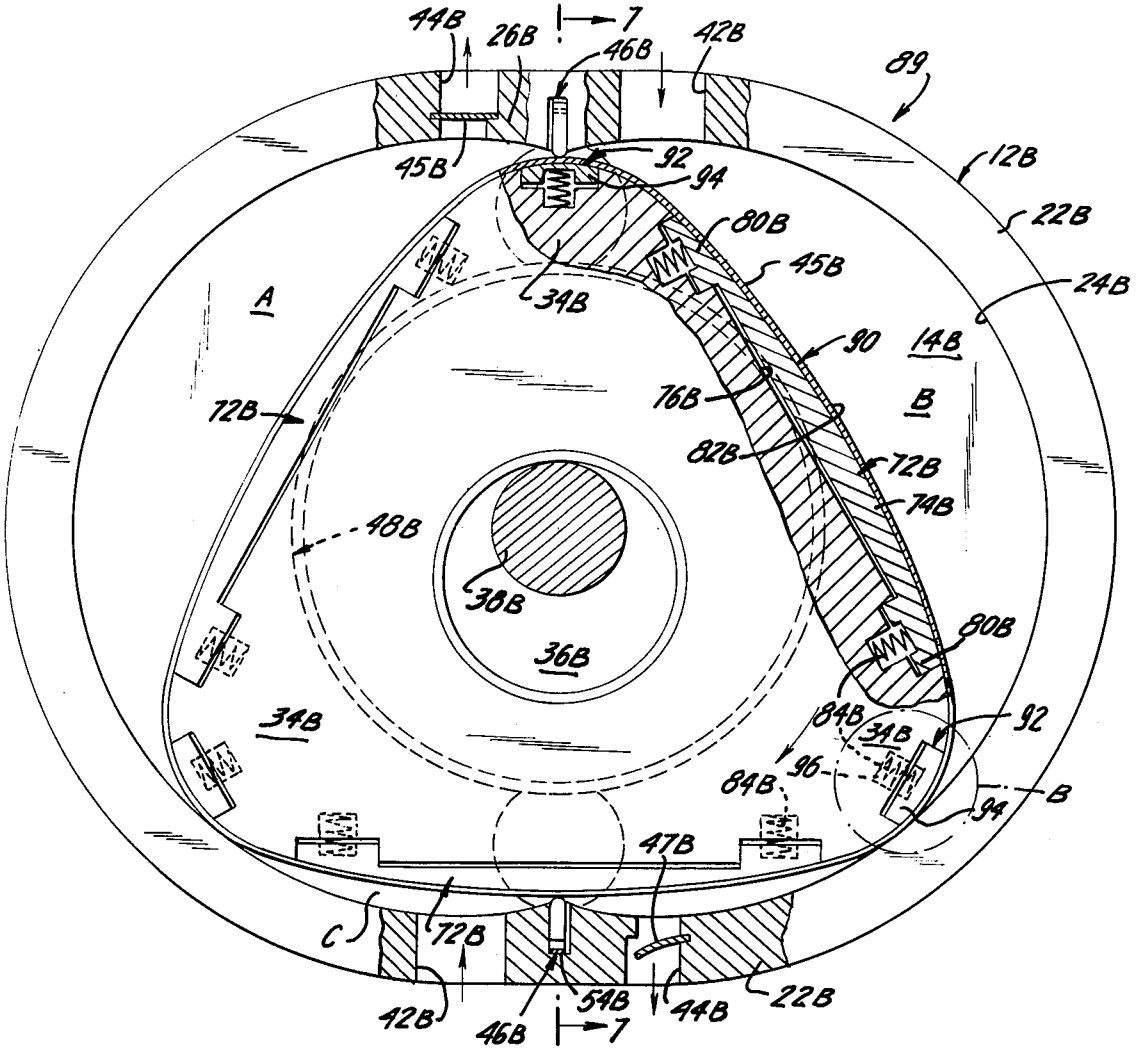
FIG. 6 is a view similar to FIGS. 1 and 3 of a rotary piston mechanism with a rotor, according to a third embodiment of this invention.

In FIGS. 6, 7 and 8 is shown a rotary piston mechanism 89 having a rotor 90, according to a third embodiment of this invention. The mechanism 89 differs from mechanism 69 of FIGS. 3 to 5 only in that its rotor 90 has, in addition to pressure plate assemblies 72, a pressure plate assembly 92 at each of the apex portions 34B. In view of the similarity of mechanisms 69 and 89, parts of mechanism 89 corresponding to like parts of mechanism 69 will be designated by the same number with a suffix B added thereto.

As shown in FIGS. 6 to 8, each pressure plate assembly 92 comprises a generally rectangular body portion 94 having an arcuate outer surface coextensive with the line T parallel to the trace of the inner envelope of a hypotrochoid. The body portion 94 is biased outwardly by a spring 96 which is held in position by a recess 98 in the underside of body portion 94 and an aligned counter-recess 100 in the rotor.

As shown in FIG. 8, spring 96 biases body portion 94 radially outward from the rotor axis so that the outer surface 102 is outwardly of the parallel line T when not restrained inwardly by junctures 26B and/or waist seals 46B.

The pressure plate assemblies 92 function to keep band 45B taut and in engagement with inner peripheral surface 24B of housing 12A without impact against waist seals 46B.

In a fourth embodiment of this invention (not illustrated) the rotor (not shown) may only have pressure plate assemblies 92 at the apex portions 34B to keep the band 45B taut and in contact with peripheral surface 24B. Thus, if the pressure plate assemblies 72 are omitted in the embodiment shown in FIGS. 6 and 7, then FIGS. 6 and 7 illustrate the fourth embodiment of this invention.

It is now believed readily apparent that this invention provides a rotor for a rotary piston mechanism of the hypotrochoid type in which sealing is effected without impacts with the stationary waist seals and wherein seal operative life is relatively long. It is a rotor which provides, for a rotary piston mechanism, a high volumetric efficiency.

Although several embodiments of the invention have been illustrated and described in detail, it is to be expressly understood that the invention is not limited thereto. Various changes can be made in the arrangement of parts without departing from the spirit of the invention as the same will now be understood by those skilled in the art.

What is claimed is:

1. In a rotary piston mechanism of the type comprising a housing with axially-spaced end walls and a peripheral wall interconnecting the end walls to form a multi-lobed cavity therebetween, a rotor mounted within said cavity for rotation on an axis eccentric to the housing cavity axis, the rotor having opposite end faces adjacent the housing end walls and a peripheral surface of a contour which substantially coincides with the trace of the inner envelope of a hypotrochoid, the rotor defining with the housing walls a plurality of working chambers which vary in volumetric size as the rotor rotates relative to the housing and intake and exhaust ports for passing fluid into and from the working chambers as the latter change in volumetric size, the improvement in the rotor comprising:

(a) an endless flexible band overlying the peripheral surface of the rotor and extending substantially the full distance between the opposite end faces of said rotor; and (b) tensioning means carried by the rotor to resiliently bias said endless flexible band in a direction radially outwardly of the rotor axis of rotation to a point beyond the trace of the rotor peripheral surface in positions of the tensioning means away from the junctures of the cavity lobes.

2. The apparatus of claim 1 wherein said tensioning means is a pressure plate slidably receivable in a recess in each apex portion and biased by spring means into engagement with the band.

3. The apparatus of claim 1 wherein said tensioning means is a pressure plate slidably receivable in a recess in each flank surface and biased by spring means into engagement with the band.

4. The apparatus of claim 1 wherein said tensioning means is a first pressure plate slidably receivable in a recess in each apex portion and a second pressure plate slidably receivable in a recess in each flank surface and wherein each of said first and second pressure plates is biased into engagement with the band to maintain the latter in contact at various parts thereof with the peripheral wall of the housing.

5. The apparatus of claim 1 wherein said tensioning means includes one or more springs acting against a pressure plate.

* * * * *